US010755637B2

(12) United States Patent
Yang et al.

(10) Patent No.: US 10,755,637 B2
(45) Date of Patent: Aug. 25, 2020

(54) DISPLAY METHOD, DISPLAY CONTROL DEVICE AND DISPLAY APPARATUS

(71) Applicant: BOE TECHNOLOGY GROUP CO., LTD., Beijing (CN)

(72) Inventors: Chengchung Yang, Beijing (CN); Kuanjun Peng, Beijing (CN); Wei Qin, Beijing (CN); Zhiqiang Xu, Beijing (CN); Yan Wei, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/251,903

(22) Filed: Jan. 18, 2019

(65) Prior Publication Data

US 2019/0333447 A1 Oct. 31, 2019

(30) Foreign Application Priority Data

Apr. 26, 2018 (CN) ..... 2018 1 0385406

(51) Int. Cl.
*G09G 3/3233* (2016.01)

(52) U.S. Cl.
CPC ..... *G09G 3/3233* (2013.01)

(58) Field of Classification Search
CPC ..... G09G 3/3233; G09G 3/3225; H04N 5/21
See application file for complete search history.

(56) References Cited

U.S. PATENT DOCUMENTS 7,505,026 B2 3/2009 Baba et al.
9,137,427 B2 9/2015 Shido et al.
9,633,608 B2 * 4/2017 Shin ..... G09G 3/20
10,403,204 B2 * 9/2019 Miyake ..... G09G 3/3233
2006/0170822 A1 8/2006 Baba et al.
2008/0068312 A1 * 3/2008 Kim ..... G09G 3/2014 345/84

(Continued)

FOREIGN PATENT DOCUMENTS

CN 1801268 A 7/2006
CN 1801304 A 7/2006

(Continued)

OTHER PUBLICATIONS

First Office Action dated Jul. 31, 2019; Corresponding to Chinese Application No. 201810385406.4; English Translation Attached.

*Primary Examiner* — Sardis F Azongha
(74) *Attorney, Agent, or Firm* — Nath, Goldberg & Meyer; Joshua B. Golberg

(57) ABSTRACT

A display method includes: determining whether there is a dynamic part in a current frame of picture, according to image data of a previous frame of picture and the current frame of picture; in a case where there is no dynamic part in the current frame of picture, in a display stage of the current frame of picture, providing a first light emitting control signal being always at an effective electric level state to each of pixel units of a display panel; in a case where there is a dynamic part in the current frame of picture, in the display stage of the current frame of picture, providing a second light emitting control signal, including a part at an effective electric level state and a part at a non-effective electric level state, to pixel units corresponding to at least a part of the dynamic part.

20 Claims, 10 Drawing Sheets

(56) References Cited

U.S. PATENT DOCUMENTS

| | | | | |
|---|---|---|---|---|
| 2009/0207193 | A1* | 8/2009 | Isobe | G09G 3/3233<br>345/690 |
| 2014/0375704 | A1* | 12/2014 | Bi | G09G 3/3275<br>345/694 |
| 2019/0012961 | A1* | 1/2019 | Kim | G09G 3/3225 |

FOREIGN PATENT DOCUMENTS

| | | | |
|---|---|---|---|
| CN | 103491286 | A | 1/2014 |
| CN | 106373530 | A | 2/2017 |
| KR | 20180003790 | A | 1/2018 |
| TW | 200707370 | A | 2/2007 |

* cited by examiner

DISPLAY METHOD, DISPLAY CONTROL DEVICE AND DISPLAY APPARATUS

CROSS-REFERENCE TO RELATED APPLICATIONS

The present application claims the priority of Chinese Patent Application No. 201810385406.4, filed on Apr. 26, 2018, the contents of which are incorporated herein in their entirety by reference.

TECHNICAL FIELD

The present disclosure relates to a display method, a display control device and a display apparatus.

BACKGROUND

As the development of the display technology, technology of Active-Matrix Organic Light Emitting Diode (AMOLED) display devices is progressing with each passing day, being increasingly applied in various fields of display.

SUMMARY

The present disclosure provides a display method, including: determining whether there is a dynamic part in a current frame of picture, according to image data of a previous frame of picture and the current frame of picture; in a case where there is no dynamic part in the current frame of picture, in a display stage of the current frame of picture, providing a first light emitting control signal to each of pixel units of a display panel, the first light emitting control signal corresponds to the display stage being always at an effective electric level state; in a case where there is a dynamic part in the current frame of picture, in the display stage of the current frame of picture, providing a second light emitting control signal to pixel units corresponding to at least a part of the dynamic part, the second light emitting control signal includes a part at an effective electric level state and a part at a non-effective electric level state.

In some embodiments, the part at the non-effective electric level state includes at least one of a period of time after the display stage starts and a period of time before the display stage ends.

In some embodiments, before the step of, in the display stage of the current frame of picture, providing a second light emitting control signal to pixel units corresponding to at least a part of the dynamic part, the method further includes: calculating a moving speed of the dynamic part; and determining a light emitting control duty ratio of the second light emitting control signal according to the moving speed, the light emitting control duty ratio of the second light emitting control signal is a ratio of a duration for which the second light emitting control signal is at the effective electric level state and a duration of the display stage.

In some embodiments, after the step of determining a light emitting control duty ratio of the second light emitting control signal according to the moving speed, the method further includes:

adjusting a Gamma reference voltage according to the determined light emitting control duty ratio of the second light emitting control signal;

generating a corresponding data voltage according to the adjusted Gamma reference voltage and a display grayscale of the pixel units; and in a drive stage before the display stage, providing the corresponding data voltage to the pixel units.

In some embodiments, the display panel is divided into a number of delimited areas in advance, and the pixel units located in a same one of the delimited areas correspond to a same light emitting control signal input terminal; the step of, in the display stage of the current frame of picture, providing the second light emitting control signal to pixel units corresponding to at least a part of the dynamic part, includes: in the display stage of the current frame of picture, providing the second light emitting control signal to each of pixel units in those of the delimited areas where the dynamic part is present, by the light emitting control signal input terminals corresponding to the delimited areas where the dynamic part is present.

In some embodiments, the method further includes: after determining that there is the dynamic part in the current frame of picture, in the display stage of the current frame of picture, providing the first light emitting control signal to each of pixel units in those of the delimited areas where the dynamic part is not present, by the light emitting control signal input terminal corresponding to the delimited areas where the dynamic part is not present.

In some embodiments, the display panel is divided into a number of delimited areas in advance, and the pixel units located in a same one of the delimited areas correspond to a same light emitting control signal input terminal; the step of, in the display stage of the current frame of picture, providing the second light emitting control signal to pixel units corresponding to at least a part of the dynamic part, includes: in the display stage of the current frame of picture, providing the second light emitting control signal to each of pixel units in each of the delimited areas, by each of corresponding light emitting control signal input terminals.

In some embodiments, the second light emitting control signals received by respective ones of the delimited areas are at an effective electric level state at sequentially staggered times respectively.

In some embodiments, each of the second light emitting control signals received by respective ones of the delimited areas is at an effective electric level state for a duration $t=T/m$; where T is a duration of the display stage, and m is a number of the delimited areas.

In some embodiments, the display method further includes: in a drive stage before the display stage, providing a third light emitting control signal to each of the pixel units in each of the delimited areas, by each of the light emitting control signal input terminals, the third light emitting control signal includes a part at an effective electric level state and a part at a non-effective electric level state, and switching of the third light emitting control signal, received by each of the delimited areas, from a non-effective electric level state to an effective electric level state occurs at sequentially delayed moments respectively.

In some embodiments, the display method further includes: in a drive stage before the display stage, providing a fourth light emitting control signal to each of the pixel units in each of the delimited areas, by each of the light emitting control signal input terminals, the fourth light emitting control signal is always at a non-effective electric level state.

In some embodiments, the display method further includes:

in a drive stage before the display stage, providing a third light emitting control signal to each of the pixel units in each of the delimited areas, by each of the corresponding light emitting control signal input terminals, wherein the third light emitting control signal includes: a part at an effective electric level state and a part at a non-effective electric level state, and switching of the third light emitting control signal, received by each of the delimited areas, from a non-effective electric level state to an effective electric level state occurs at sequentially delayed moments.

In some embodiments, the display method further includes:

in a drive stage before the display stage, providing a fourth light emitting control signal to each of the pixel units in each of the delimited areas, by each of the corresponding light emitting control signal input terminals, wherein the fourth light emitting control signal is always at a non-effective electric level state.

In some embodiments, a number of the delimited areas ranges from 2 to 6.

In some embodiments, a number of the delimited areas is 4.

The present disclosure further provides a display control device, including: an image detector, configured to determine whether there is a dynamic part in a current frame of picture, according to image data of a previous frame of picture and the current frame of picture; a first control signal output circuit, coupled to the image detector, and configured to provide, in a case where the image detector determines that there is no dynamic part in the current frame of picture, in a display stage of the current frame of picture, a first light emitting control signal to each of pixel units of a display panel, the first light emitting control signal corresponds to the display stage being always at an effective electric level state; a second control signal output circuit, coupled to the image detector, and configured to, in a case where the image detector determines that there is a dynamic part in the current frame of picture, in the display stage of the current frame of picture, provide a second light emitting control signal to pixel units corresponding to at least a part of the dynamic part, the second light emitting control signal includes a part at an effective electric level state and a part at a non-effective electric level state.

In some embodiments, the part at the non-effective electric level state corresponds to at least one of a period of time after the display stage starts and a period of time before the display stage ends.

In some embodiments, the display control device further includes: a calculation circuit, coupled to the image detector, and configured to calculate a moving speed of the dynamic part according to image data of the previous frame of picture and the current frame of picture; a first determination circuit, coupled to the calculation circuit, and configured to determine a light emitting control duty ratio of the second light emitting control signal according to the moving speed, the light emitting control duty ratio of the second light emitting control signal is a ratio of a duration for which the second light emitting control signal is at the effective electric level state and a duration of the display stage.

In some embodiments, the display control device further includes: a Gamma adjustment circuit, coupled to the first determination circuit, and configured to, after the first determination circuit determines the light emitting control duty ratio of the second light emitting control signal, adjust a Gamma reference voltage according to the light emitting control duty ratio of the second light emitting control signal determined by the first determination circuit; a source drive circuit, coupled to the Gamma adjustment circuit, and configured to generate a corresponding data voltage, according to the adjusted Gamma reference voltage and a display grayscale of the pixel units, and provide the corresponding data voltage to the pixel units.

The present disclosure further provides a display apparatus, including: the display control device described above.

DETAILED DESCRIPTION

In order for a person skilled in the art to better understand technical solutions of the present disclosure, a display method, a display control device and a display apparatus according to the present disclosure are described in detail below in conjunction with the accompanying drawings.

With AMOLED as a hold-type display technology, when displaying a dynamic picture moving at a high speed, since perception generated in the brain after seeing the dynamic picture by human eyes deviates from actual displayed position of that picture in the display panel, the brain of the viewer produces a feeling of smearing blur.

In the related art, displaying any one frame of picture always includes two stages: a drive stage and a display stage. In the drive stage, a gate drive circuit outputs scanning signals one by one to each of gate lines on the display panel, and data lines supply data voltages to pixel units, to drive each of the pixel units; in the display stage, all of the pixel units of the display panel emit light continuously, to display a full image. Since a duration of the drive stage is far shorter than a duration of the display stage, a duration of displaying one frame of picture may be approximately equal to the duration of one display stage.

Figure 1:
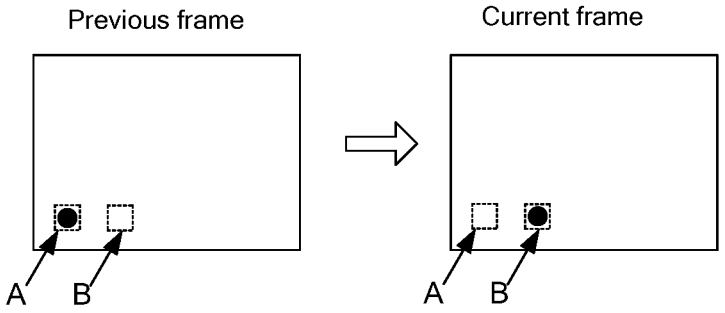
FIG. 1 is a schematic diagram showing movement of a moving object moving from region A to region B by using two consecutive frames of picture.

The smear problem in the related art will be described in detail below in conjunction with accompanying drawings. FIG. 1 is a schematic diagram showing movement of a moving object moving from region A to region B by using two consecutive frames of picture. As shown in FIG. 1, in a previous frame of picture, the moving object is at region A of the display panel; in a current frame of picture, the moving object is at region B of the display panel. It can be shown by these two consecutive frames of picture that the moving object moves from region A to region B at a certain speed V along a horizontal rightward direction.

Figure 2:
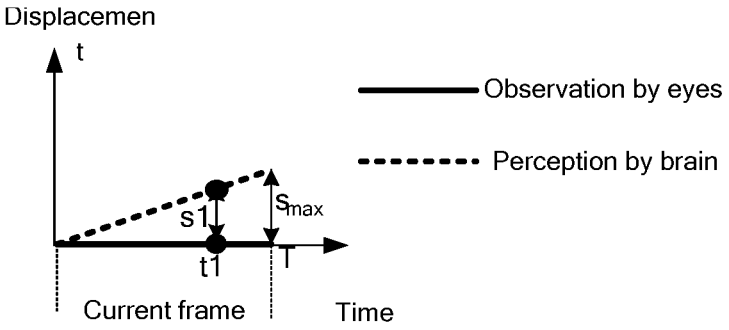
FIG. 2 is a schematic diagram showing how an actual displacement of the moving object viewed by eyes of a user and a perceptual displacement of the moving object perceived by the user's brain change with time.

FIG. 2 is a schematic diagram showing how an actual displacement of the moving object viewed by eyes of a user and a perceptual displacement of the moving object perceived by the user's brain change with time. As shown in FIG. 2, in the current frame of picture displayed by the display panel, the moving object is always at region B, and the moving object actually observed by the user's eyes is also at region B all the time; however, due to some perceptional inertia in perception of a moving picture by the user's brain, at the moment when the current frame of picture is initially displayed and observed by the user's eyes, the user's brain may produce a feeling as if the moving object moves from region B at a certain speed V along a horizontal rightward direction (which is the tendency of movement of the current frame of picture compared to the previous frame of picture). That is to say, in the process of displaying the current frame of picture, the user's brain perceives movement of the moving object from region B at the speed V along the horizontal rightward direction.

For example, at moment t1 during the display of the current frame of picture, the "moving" object actually displayed by the current frame of picture has no displacement, while the moving object perceived by the user's brain produces a displacement s1 (s1=V*t1), so there is a deviation of a position of the moving object perceived by the brain from the actual position of the moving object displayed by the current frame of picture. Also, the greater the displacement s1 is, the longer the smear is felt by the user, that is, the more obvious the feeling of smearing blur is.

In the related art, in the process of displaying a frame of picture, pixel units all perform display in the display stage, thus when this frame of picture contains a dynamic part (a part of image data of the current frame of picture different from image data of the previous frame of picture), the user feels the longest smear at a moment when this frame is about to end and the next frame is about to start (the position of the moving object perceived by the brain has a maximum deviation from the actual position of the moving object displayed by the displayed frame of picture), and the feeling of smearing blur is the most obvious. Assuming one display stage corresponds to a duration T, when this frame of picture is continuously displayed for the duration T, the user may feel the maximum length of smear $S_{max}$, $S_{max}$=V*T.

With regard to this, the present disclosure provides a display method, a display control device and a display apparatus.

Figure 3:
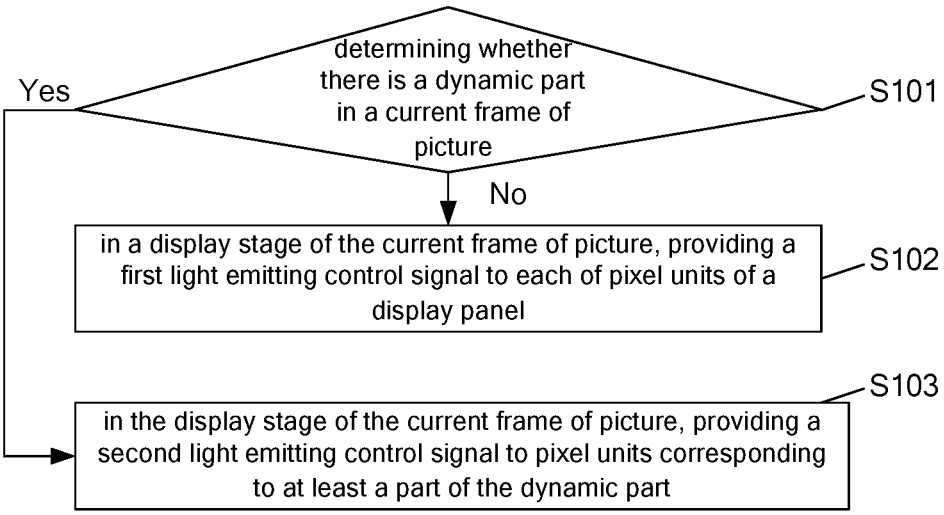
FIG. 3 is a flow chart of a display method according to an embodiment of the present disclosure.

FIG. 3 is a flow chart of a display method according to an embodiment of the present disclosure. As shown in FIG. 3, the display method is for displaying a current frame of picture, and the display method may include Steps S101 through S103.

Step S101: determining whether there is a dynamic part in a current frame of picture, according to image data of a previous frame of picture and the current frame of picture.

In Step S101, image data corresponding to the current frame of picture and image data corresponding to the previous frame of picture may be compared by image processing technology; if the two pieces of data information are identical, it may be determined that the two frames of picture are identical, that is, the current frame of picture does not have a dynamic part compared to the previous frame of picture; if the two pieces of data information are not identical, it may be determined that the two frames of picture are not identical, that is, the current frame of picture has a dynamic part compared to the previous frame of picture; a region corresponding to the dynamic part (a region where image data are different from those in the previous frame of picture) may also be determined at the same time.

It should be noted that the "dynamic part" in the present disclosure may not refer to a real existing changeable part in a frame of picture, but refers only to a part of the current frame of picture, compared to the previous frame of picture, having image data different than the previous frame of picture.

In an embodiment of the present disclosure, if it is determined in Step S101 that there is no dynamic part in the current frame of picture, Step S102 is performed; otherwise, if it is determined in Step S101 that there is a dynamic part in the current frame of picture, Step S103 is performed.

Step S102: in a display stage of the current frame of picture, providing a first light emitting control signal to each of pixel units of a display panel.

The first light emitting control signal is at an effective electric level state throughout the display stage.

Step S103: in the display stage of the current frame of picture, providing a second light emitting control signal to pixel units corresponding to at least a part of the dynamic part.

The second light emitting control signal includes: a part at an effective electric level state and a part at a non-effective electric level state, wherein the part at the effective electric level state corresponds to time during which the display stage is at an effective electric level state, the part at the non-effective electric level state corresponds to time during which the display stage is at a non-effective electric level state. For example, the time during which the display stage is at the non-effective electric level state may be a period of time after the display stage starts and/or a period of time before the display stage ends.

It should be noted that in an embodiment of the present disclosure, "a period of time after the display stage starts" refers to a time period from the start of the display stage to a certain moment in the display stage; "a period of time before the display stage ends" refers to a time period from a certain moment in the display stage to the end of the display stage.

Figure 4:
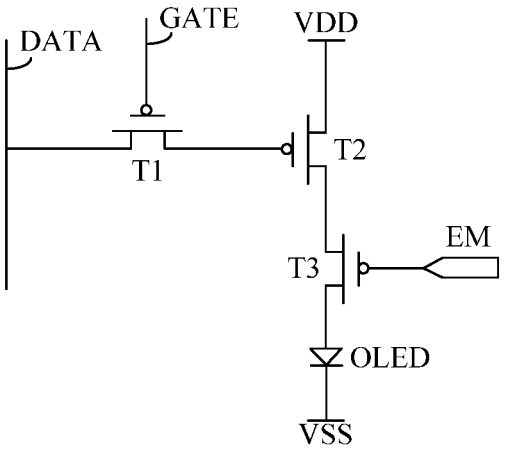
FIG. 4 is a schematic diagram of a circuit structure of one pixel drive circuit in an AMOLED display panel.

FIG. 4 is a schematic diagram of a circuit structure of one pixel drive circuit in an AMOLED display panel. As shown in FIG. 4, the AMOLED display panel may include a pixel array constructed by several pixel units, inside each of the pixel units there is provided one pixel drive circuit and a corresponding organic light emitting diode (OLED), and the pixel drive circuit generally includes: a switching transistor T1, a driving transistor T2 and a light emitting control transistor T3; wherein a control electrode of the switching transistor T1 is coupled to a gate line GATE, a first electrode of the switching transistor T1 is coupled to a data line DATA, a second electrode of the switching transistor T1 is coupled to a control electrode of the driving transistor T2, a first electrode of the driving transistor T2 is coupled to a first operation power supply terminal, a second electrode of the driving transistor T2 is coupled to a first electrode of the light emitting control transistor T3, a control electrode of the light emitting control transistor T3 is coupled to a light emitting control signal input terminal EM, a second electrode of the light emitting control transistor T3 is coupled to a first electrode of the OLED, and a second electrode of the OLED is coupled to a second operation power supply terminal.

The light emitting control signal input terminal EM is configured to provide a light emitting control signal to the control electrode of the light emitting control transistor T3. The light emitting control signal being at an "effective electric level state" means that it is at an electric level state in which the light emitting control signal can control the light emitting control transistor T3 to be turned on; the light emitting control signal being at a "non-effective electric level state" means that it is at an electric level state in which the light emitting control signal can control the light emitting control transistor T3 to be turned off. If the light emitting control transistor T3 is a P-type transistor, the effective electric level state is a low electric level state, and the non-effective electric level state is a high electric level state; if the light emitting control transistor T3 is a N-type transistor, the effective electric level state is a high electric level state, and the non-effective electric level state is a low electric level state. In an embodiment of the present disclosure, description is made taking an example in which the transistors are P-type transistors.

In addition, a control electrode of a transistor refers to a gate of the transistor, one of a first electrode and a second electrode of the transistor is a source of the transistor, and the other is a drain of the transistor. The first operation power supply terminal provides a first operation voltage, and the second operation power supply terminal provides a second operation voltage. The accompanying drawing schematically shows a case where the first operation voltage is a high electric level voltage VDD, and the second operation voltage is a low electric level voltage VSS.

During display of one frame, a light emitting duration of the OLED is determined by a duration for which the light emitting control signal is at an effective electric level state in the display stage.

If it is determined in Step S101 that the current frame of picture does not contain a dynamic part, a first light emitting control signal which is always at an effective electric level state is provided to each of the pixel units of the display panel, and the OLED of each of the pixel units emits light continuously throughout the display stage.

If it is determined in Step S101 that the current frame of picture contains a dynamic part, a second light emitting control signal is provided to pixel units corresponding to at least a part of the dynamic part, so that there exist time during which these pixel units do not emit light in the display stage of the current frame of picture, for example, do not emit light for a period of time after the display stage starts and/or a period of time before the display stage ends, to shorten a duration during which the dynamic part is continuously displayed in the current frame of picture, the maximum deviation of a perceptual position of a moving part perceived by the user's brain from an actual position of the moving part actually observed by the user's eyes is reduced, that is, the longest smear that can be felt by the user is shortened, and the feeling of smearing blur is weakened. A technical principle of the present disclosure will be described in detail below in conjunction with the accompanying drawings.

Figure 5:
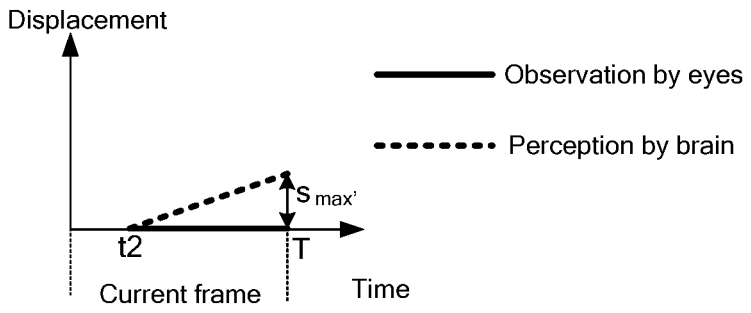
FIG. 5 is a schematic diagram showing how an actual displacement of a moving object viewed by user's eyes and a perceptual displacement of the moving object perceived by the user's brain change with time, when the moving object does not emit light for a period of time after the display stage starts, in the present disclosure.

FIG. 5 is a schematic diagram showing how an actual displacement of a moving object viewed by user's eyes and a perceptual displacement of the moving object perceived by the user's brain change with time, when the moving object does not emit light for a period of time after the display stage starts, in the present disclosure. As shown in FIG. 5, the part at a non-effective electric level state of the second light emitting control signal corresponds to the period of time t2 after the display stage starts, that is, an OLED in a pixel unit which receives the second light emitting control signal does not emit light during the time t2 after the display stage starts.

For example, still as shown in FIG. 1, in the case of the moving object moving from region A to region B in two consecutive frames of picture, when the current frame of picture is displayed (the moving object is at region B), during the first time t2 of the display stage, OLED(s) at region B do not emit light. Since the user's eyes cannot observe the moving object, the user's brain cannot perceive tendency of movement of the moving object in the current frame of picture compared to the previous frame of picture.

After the time t2 of the display stage, OLED(s) at region B emit light, the user's eyes can observe the moving object, and the brain can perceive that the moving object has a tendency of moving rightwards horizontally, according to an image of the moving object at region B of the current frame of picture and an image of the moving object at region A of the previous frame of picture. During time (T−t2) thereafter, the user's brain perceives that the moving object moves from region B at a speed V along a horizontal rightward direction. At the same time, the current frame of picture actually shows that the moving object is always at region B, that is, the user's eyes observes that the moving object is always at region B. At the end of the display stage, the perceptual position of the moving object perceived by the user's brain has a maximum deviation from the true position of the moving object actually observed by the user's eyes, and the longest smear that could be felt by the user is $S_{max}'=V*(T-t2)$, $S_{max}'<S_{max}$, that is, the longest smear is shortened, thus weakening the smearing blur feeling.

Figure 6:
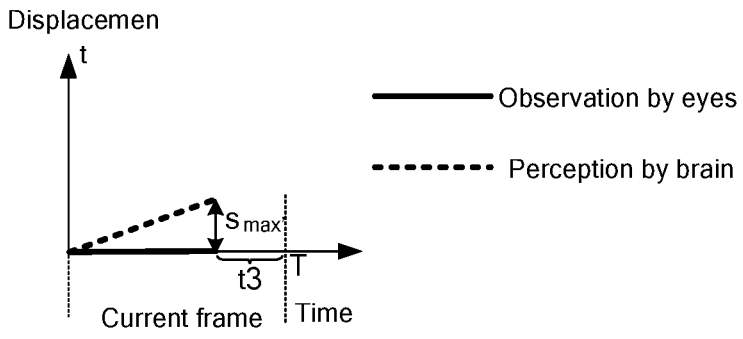
FIG. 6 is a schematic diagram showing how an actual displacement of a moving object viewed by user's eyes and a perceptual displacement of the moving object perceived by the user's brain change with time, when the moving object does not emit light for a period of time before the display stage ends, in the present disclosure.

FIG. 6 is a schematic diagram showing how an actual displacement of a moving object viewed by user's eyes and a perceptual displacement of the moving object perceived by the user's brain change with time, when the moving object does not emit light for a period of time before the display stage ends, in the present disclosure. As shown in FIG. 6, the part at a non-effective electric level state of the second light emitting control signal corresponds to the period of time t3 before the display stage ends, that is, an OLED in a pixel unit which receives the second light emitting control signal does not emit light during the time t3 before the display stage ends.

For example, still as shown in FIG. 1, in the case of the moving object moving from region A to region B in two consecutive frames of picture, when the current frame of picture is displayed (the moving object is at region B), during the time t3 before the end of the display stage, OLED(s) at region B do not emit light.

At the beginning of the display stage, OLED(s) at region B emit light, the user's eyes can observe the moving object, and the user's brain can perceive that the moving object has a tendency of moving rightwards horizontally, according to an image of the moving object at region B of the current frame of picture and an image of the moving object at region A of the previous frame of picture. During time (T−t3) after the display stage starts, the user's brain perceives that the moving object moves from region B at a speed V along a horizontal rightward direction. At the same time, the current frame of picture actually shows that the moving object is always at region B, that is, the user's eyes observes that the moving object is always at region B. When the OLED(s) at region B switches from a light emitting state to a non-luminous state, the perceptual position of the moving object perceived by the user's brain has a maximum deviation from the true position of the moving object actually observed by the user's eyes, and the longest smear that could be felt by the user is $S_{max}'=V*(T-t3)$, $S_{max}'<S_{max}$, that is, the longest smear is shortened, thus weakening the smearing blur feeling.

It should be known to one skilled in the art that, controlling, using the second light emitting control signal, the moving part of the current frame of picture to emit no light for both a period of time after the display stage starts and a period of time before the display stage ends, or emit no light for any other time of the display stage, can also reduce the duration for which the dynamic part is continuously displayed in the current frame of picture, which can also shorten the longest smear that could be felt by the user and weaken the smearing blur feeling, based on the similar technical principle which is not repeated herein.

An embodiment of the present disclosure provides a display method, in which, if it is determined that the current frame of picture contains a dynamic part, a second light emitting control signal is provided to pixel units corresponding to at least a part of the dynamic part, such that these pixel units does not emit light for a period of time when the display stage of the current frame of picture is at a non-effective electric level state, to shorten a duration for which the dynamic part is continuously displayed in the current frame of picture, the maximum deviation of a perceptual position of a moving part perceived by the user's brain from an actual position of the moving part actually observed by the user's eyes is decreased, that is, the longest smear that can be felt by the user is shortened, and the feeling of smearing blur is weakened.

Figure 7:
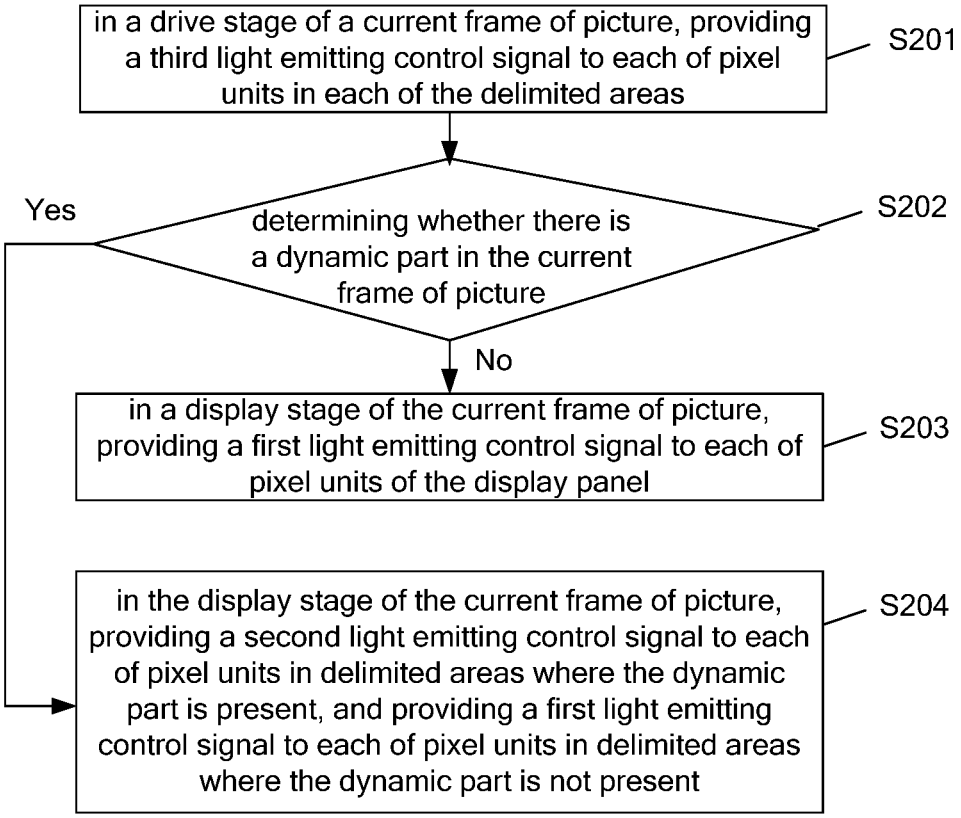
FIG. 7 is a flow chart of a display method according to an embodiment of the present disclosure.

FIG. 7 is a flow chart of another display method according to an embodiment of the present disclosure. As shown in FIG. 7, in the present embodiment, the display panel is divided into a number of delimited areas in advance, and pixel units located in a same delimited area correspond to a same light emitting control signal input terminal. The display method may include Steps S201 through S204.

Step S201: in a drive stage of a current frame of picture, providing a third light emitting control signal to each of pixel units in each of the delimited areas.

The third light emitting control signal may include a part at an effective electric level state and a part at a non-effective electric level state, and switching of the third light emitting control signal from the non-effective electric level state to the effective electric level state occurs at sequentially delayed moments in respective delimited areas.

Step S202: determining whether there is a dynamic part in the current frame of picture, according to image data of a previous frame of picture and the current frame of picture.

In the present disclosure, if it is determined in Step S202 that there is no dynamic part in the current frame of picture, Step S203 is performed; otherwise, if it is determined in Step S202 that there is a dynamic part in the current frame of picture, Step S204 is performed.

Step S203: in a display stage of the current frame of picture, providing a first light emitting control signal to each of pixel units of the display panel.

The first light emitting control signal is always at an effective electric level state.

Step S204: in the display stage of the current frame of picture, providing a second light emitting control signal to each of pixel units in delimited areas where the dynamic part is present, and providing a first light emitting control signal to each of pixel units in delimited areas where the dynamic part is not present.

The technical solution of the present embodiment will be described in detail below in conjunction with a specific example.

Figure 8:
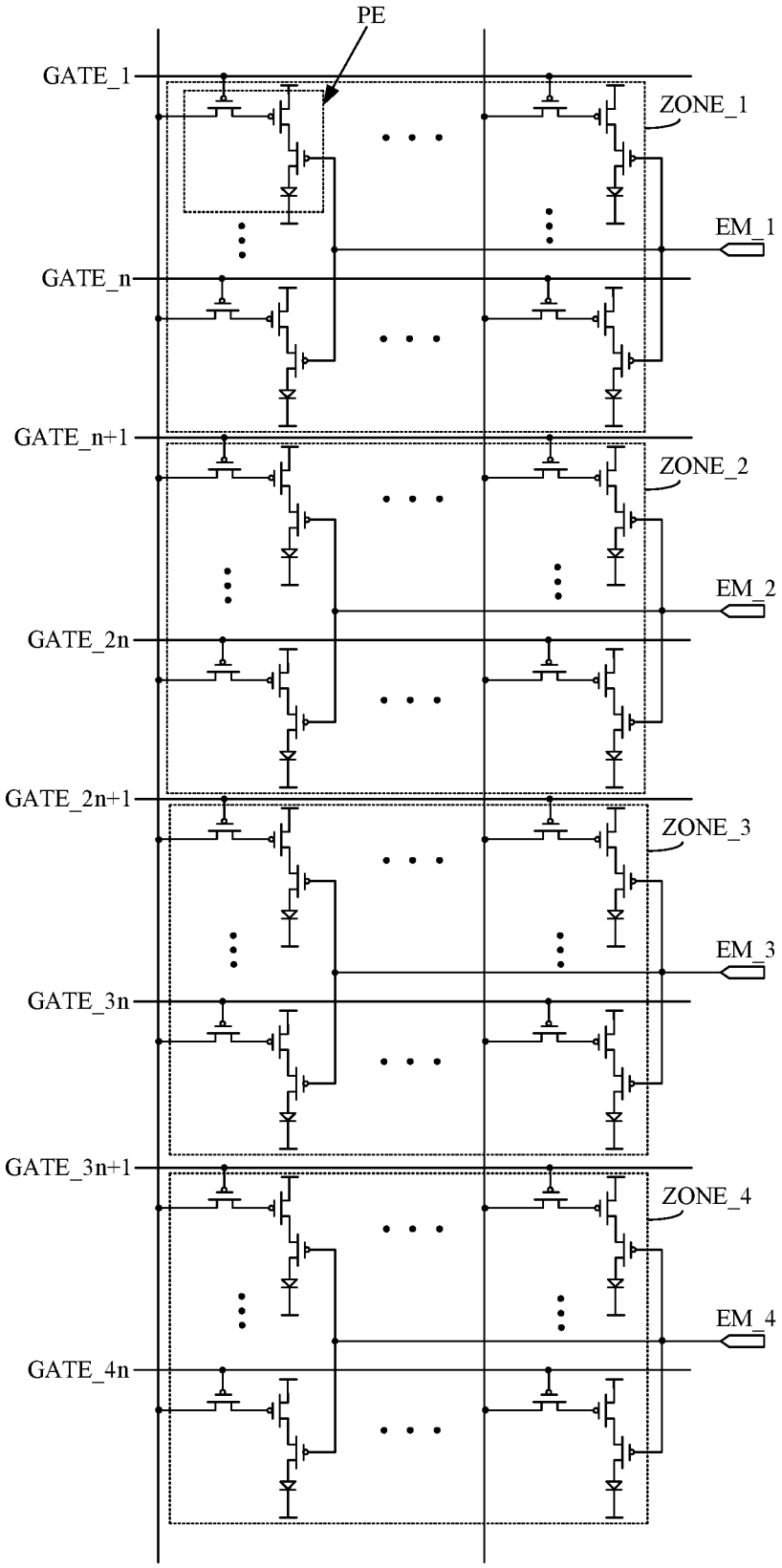
FIG. 8 is a schematic diagram of a circuit structure of all pixel drive circuits in an AMOLED display panel according to an embodiment of the present disclosure.

FIG. 8 is a schematic diagram of a circuit structure of all pixel drive circuits in an AMOLED display panel according to an embodiment of the present disclosure. As shown in FIG. 8, there is four delimited areas in the display panel, and the four delimited areas are arranged in a column direction; the four delimited areas are denoted as a first delimited area ZONE_1, a second delimited area ZONE_2, a third delimited area ZONE_3, and a fourth delimited area ZONE_4 in sequence, each of the delimited areas ZONE_1, ZONE_2, ZONE_3, and ZONE_4 contains n rows of pixel units PE, and four light emitting control signal input terminals for controlling the four delimited areas ZONE_1, ZONE_2, ZONE_3, and ZONE_4 are sequentially denoted as a first light emitting control signal input terminal EM_1, a second light emitting control signal input terminal EM_2, a third light emitting control signal input terminal EM_3, and a fourth light emitting control signal input terminal EM_4.

Figure 9A:
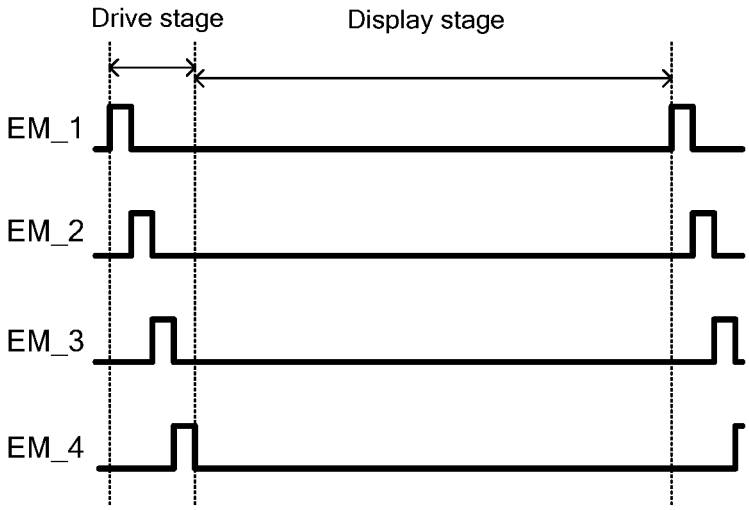
FIG. 9*a* is an operation timing diagram of the light emitting control signal input terminals when there is no dynamic part in the current frame of picture, in the embodiment shown in FIGS. 7 and 8 in the present disclosure.

FIG. 9*a* is an operation timing diagram of the light emitting control signal input terminals when there is no dynamic part in the current frame of picture, in the embodiment shown in FIGS. 7 and 8 in the present disclosure. As shown in FIG. 9*a*, a process of displaying this frame may include a drive stage and a display stage.

In the drive stage, a gate line drive circuit sequentially outputs a gate drive signal to each of gate lines GATE_1 through GATE_4*n* corresponding to respective rows of pixel units PE, to scan line by line all of the gate lines GATE_1 through GATE_4*n*. Each of the first light emitting control signal input terminal EM_1, the second light emitting control signal input terminal EM_2, the third light emitting control signal input terminal EM_3, and the fourth light emitting control signal input terminal EM_4 provides a third light emitting control signal, and the four third light emitting control signals switch from a non-effective electric level state to an effective electric level state at four moments sequentially delayed by a predetermined time.

During the line-by-line scanning of the gate lines GATE_1 through GATE_4*n* by the gate line drive circuit, OLED is prone to false light-emission. In order to prevent the problem of false light emission, in the present disclosure, after completing scanning of the last gate line in each delimited area, the third light emitting control signal controls all pixel units in this delimited area to emit light simultaneously. The predetermined time is determined by the number of rows n of the pixel units PE contained in each delimited area, and specifically, the predetermined time may be n*t, where t is time it takes for the gate drive circuit to scan one gate line.

In the display stage, each of the first light emitting control signal input terminal EM_1, the second light emitting control signal input terminal EM_2, the third light emitting control signal input terminal EM_3, and the fourth light emitting control signal input terminal EM_4 provides a first light emitting control signal. Since the first light emitting control signal is always at an effective electric level state, pixel units PE of each of the delimited areas ZONE_1, ZONE_2, ZONE_3, and ZONE_4 continuously emit light.

It is to be noted that, while pixel units in the first delimited area ZONE_1, the second delimited area ZONE_2, the third delimited area ZONE_3, and the fourth delimited area ZONE_4 start to emit light in the drive stage, considering the relatively short duration of the drive stage, they can be regarded as emitting light when the display stage starts.

Figure 9B:
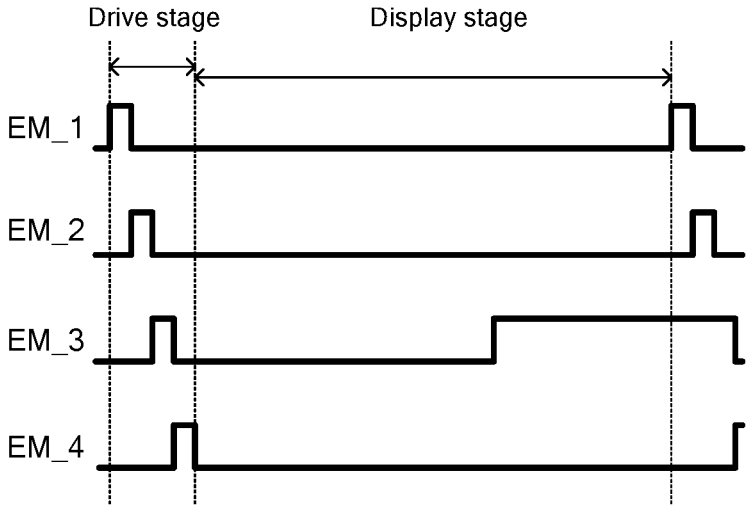
FIG. 9*b* is an operation timing diagram of the light emitting control signal input terminals when there is a dynamic part in the current frame of picture, in the embodiment shown in FIGS. 7 and 8 in the present disclosure.

FIG. 9*b* is an operation timing diagram of the light emitting control signal input terminals when there is a dynamic part in the current frame of picture, in the embodiment shown in FIGS. 7 and 8 in the present disclosure. As shown in FIG. 9*b*, for example, there is a dynamic part in the third delimited area ZONE_3, while the first delimited area ZONE_1, the second delimited area ZONE_2, and the fourth delimited area ZONE_4 have no dynamic part therein.

As for a specific operation process of the drive stage in FIG. 9*b*, one may refer to the foregoing description of the drive stage in FIG. 9*a*, which is not repeated herein.

In the display stage, each of the first light emitting control signal input terminal EM_1, the second light emitting control signal input terminal EM_2, and the fourth light emitting control signal input terminal EM_4 provides a first light emitting control signal, and the third light emitting control signal input terminal EM_3 provides a second light emitting control signal.

Because each of the first light emitting control signal input terminal EM_1, the second light emitting control signal input terminal EM_2, and the fourth light emitting control signal input terminal EM_4 provides the first light emitting control signal, and the first light emitting control signal is continuously at an effective electric level state, pixel units PE in the first delimited area ZONE_1, the second delimited area ZONE_2, and the fourth delimited area ZONE_4 continuously emit light in the display stage.

It can be seen from FIG. 9*b* that, because the third light emitting control signal input terminal EM_3 provides the second light emitting control signal, and the second light emitting control signal is at a non-effective electric level state during a period of time before the display stage ends, pixel units PE in the third delimited area ZONE_3 do not emit light during the period of time before the display stage ends, so that the longest smear of the dynamic part that can be felt by the user is shortened (one can refer to the foregoing description of FIG. 6 for the specific principle), and the feeling of smearing blur is weakened. In the present embodiment, light emitting duration of pixel units only in the third delimited area ZONE_3 having the dynamic part is shortened, while light emitting time duration remain unchanged for pixel units in the first delimited area ZONE_1, the second delimited area ZONE_2, and the fourth delimited area ZONE_4 which do not have the dynamic part, and thus the first delimited area ZONE_1, the second delimited area ZONE_2, and the fourth delimited area ZONE_4 maintain unchanged brightness.

Figure 10:
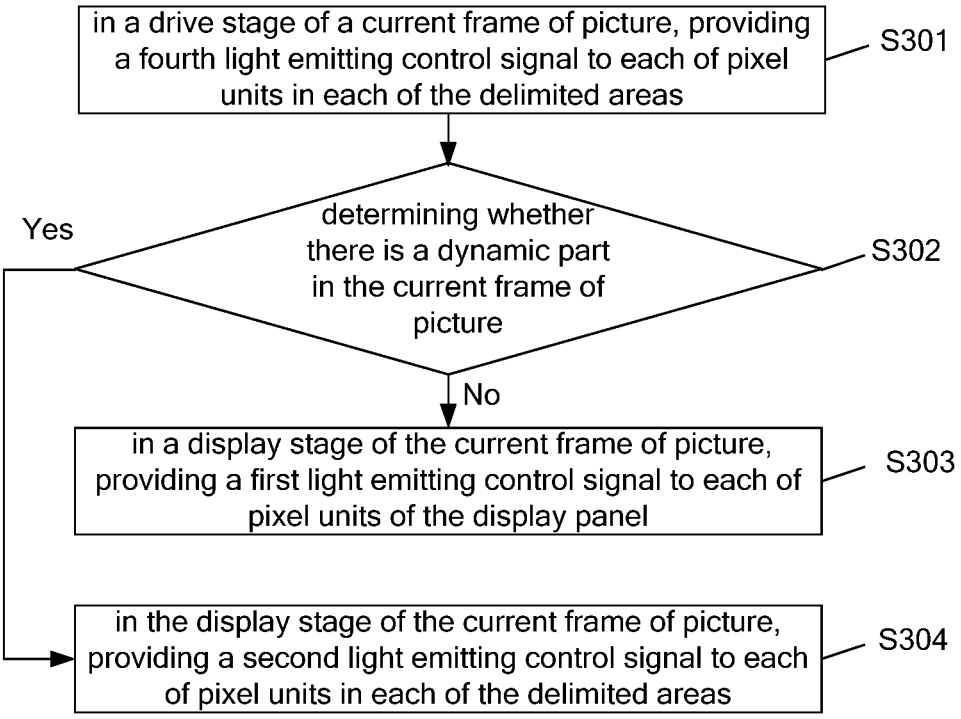
FIG. 10 is a flow chart of a display method according to an embodiment of the present disclosure.

FIG. 10 is a flow chart of a display method according to an embodiment of the present disclosure. As shown in FIG. 10, in the present embodiment, the display panel is divided into a number of delimited areas in advance, and pixel units located in a same delimited area correspond to a same light emitting control signal input terminal. The display method may include Steps S301 through S304.

Step S301: in a drive stage of a current frame of picture, providing a fourth light emitting control signal to each of pixel units in each of the delimited areas.

The fourth light emitting control signal is always at a non-effective electric level state.

Step S302: determining whether there is a dynamic part in the current frame of picture, according to image data of a previous frame of picture and the current frame of picture.

In an embodiment of the present disclosure, if it is determined in Step S302 that there is no dynamic part in the current frame of picture, Step S303 is performed; otherwise, if it is determined in Step S302 that there is a dynamic part in the current frame of picture, Step S304 is performed.

Step S303: in a display stage of the current frame of picture, providing a first light emitting control signal to each of pixel units of the display panel.

Step S304: in the display stage of the current frame of picture, providing a second light emitting control signal to each of pixel units in each of the delimited areas.

Optionally, the second light emitting control signals received by respective delimited areas are at an effective electric level state at sequentially staggered times. Further optionally, each of the second light emitting control signals received by respective delimited areas is at an effective electric level state for a duration t=Tim; where T is the duration of the display stage, and m is the number of the delimited areas.

The technical solution of the present embodiment will be described in detail below in conjunction with a specific example, where the display panel is divided into delimited areas in the same manner as shown in FIG. 8.

Figure 11A:
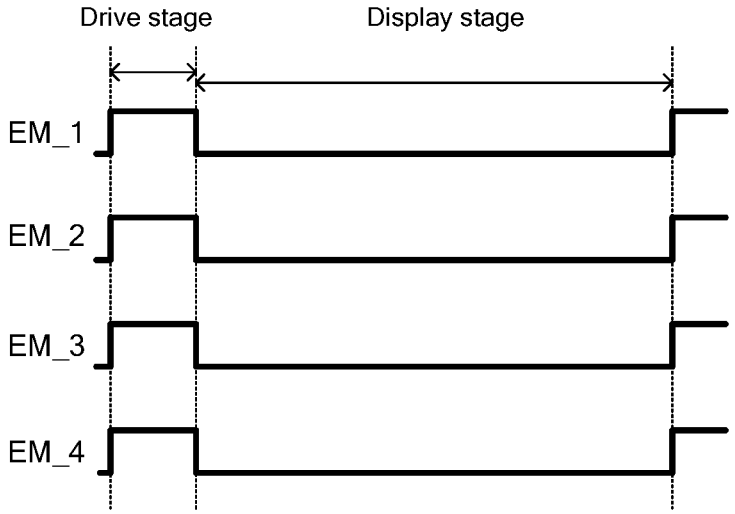
FIG. 11*a* is an operation timing diagram of the light emitting control signal input terminals when there is no dynamic part in the current frame of picture, in the embodiment shown in FIG. 10 in the present disclosure.

FIG. 11*a* is an operation timing diagram of the light emitting control signal input terminals when there is no dynamic part in the current frame of picture, in the embodiment shown in FIG. 10 in the present disclosure. As shown in FIG. 11*a*, a process of displaying this frame may include a drive stage and a display stage.

In the drive stage, a gate line drive circuit sequentially outputs a gate drive signal to each of gate lines GATE_1 through GATE_4*n* corresponding to respective rows of pixel units PE, to scan line by line all of the gate lines GATE_1 through GATE_4*n*. Each of the first light emitting control signal input terminal EM_1, the second light emitting control signal input terminal EM_2, the third light emitting control signal input terminal EM_3, and the fourth light emitting control signal input terminal EM_4 provides a fourth light emitting control signal, and the fourth light emitting control signal is always at a non-effective electric level state, so pixel units in each of the delimited areas ZONE_1, ZONE_2, ZONE_3, and ZONE_4 do not emit light.

In the display stage, each of the first light emitting control signal input terminal EM_1, the second light emitting control signal input terminal EM_2, the third light emitting control signal input terminal EM_3, and the fourth light emitting control signal input terminal EM_4 provides a first light emitting control signal. Since the first light emitting control signal is always at an effective electric level state, pixel units PE of each of the delimited areas ZONE_1, ZONE_2, ZONE_3, and ZONE_4 continuously emit light.

Figure 11B:
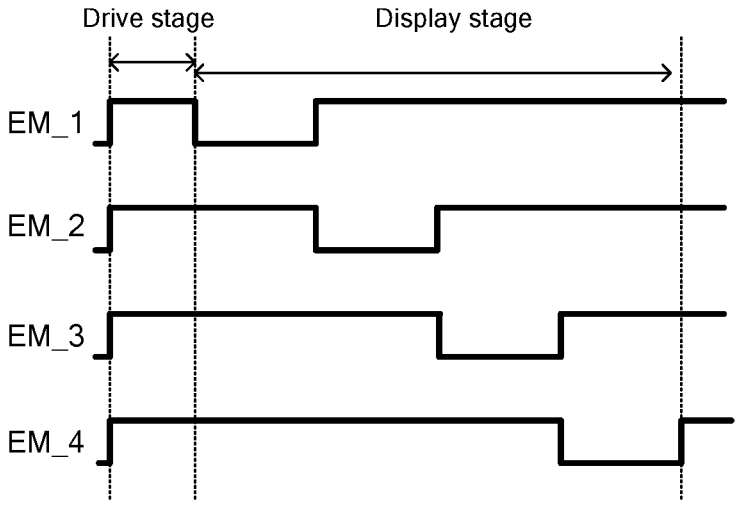
FIG. 11*b* is an operation timing diagram of the light emitting control signal input terminals when there is a dynamic part in the current frame of picture, in the embodiment shown in FIG. 10 in the present disclosure.

FIG. 11*b* is an operation timing diagram of the light emitting control signal input terminals when there is a dynamic part in the current frame of picture, in the embodiment shown in FIG. 10 in the present disclosure. As shown in FIG. 11*b*, for example, there is a dynamic part in the third delimited area ZONE_3, while the first delimited area ZONE_1, the second delimited area ZONE_2, and the fourth delimited area ZONE_4 have no dynamic part.

As for a specific operation process of the drive stage in FIG. 11*b*, one may refer to the foregoing description of the drive stage in FIG. 11*a*, which is not repeated herein.

In the display stage, each of the first light emitting control signal input terminal EM_1, the second light emitting control signal input terminal EM_2, the third light emitting control signal input terminal EM_3, and the fourth light emitting control signal input terminal EM_4 provides a second light emitting control signal, each second light emitting control signal is at an effective electric level state for a duration of T/4, and the second light emitting control signal are at the effective electric level state at sequentially staggered times respectively.

It can be seen from FIG. 11*b* that, because pixel units PE in the third delimited area ZONE_3 do not emit light both for the first time ½T of the display stage and for the last time ¼T of the display stage, the longest smear of the dynamic part that can be felt by the user can be shortened (one can refer to the foregoing description of FIGS. 5 and 6 for the specific principle), and the feeling of smearing blur can be weakened.

In the present embodiment, while there is no dynamic part in the first delimited area ZONE_1, the second delimited area ZONE_2, and the fourth delimited area ZONE_4, by shortening light emitting duration of pixel units in these three delimited areas ZONE_1, ZONE_2, and ZONE_4, the light emitting duration of pixel units PE in these three delimited areas ZONE_1, ZONE_2, and ZONE_4 can be caused to equal the light emitting duration of pixel units PE in the third delimited area ZONE_3, and as such, delimited areas ZONE_1, ZONE_2, ZONE_3, and ZONE_4 can have more similar equivalent output brightness, making display brightness of areas of the current frame of picture more uniform.

It is to be noted that, in the present embodiment, each of the second light emitting control signals received by respective delimited areas may be at an effective electric level state for a duration not limited to T/m.

The example shown in FIG. 8 where there are four delimited areas and the four delimited areas are arranged in a column direction, is merely exemplarily, not intended to limit technical solutions of the present disclosure. Technical solutions of the present disclosure impose no limit upon the number of the delimited areas and specific arrangement of the delimited areas.

Considering that a larger number of delimited areas leads to a higher precision of adjustment but increased complexity of adjustment and higher requirements for a control chip, optionally, in the present disclosure, the number of delimited areas may range from 2 to 6.

Additionally, since the duration of the drive stage is far shorter than the duration of the display stage, whether pixel units in delimited areas start to display in the drive stage (as shown in FIGS. 9*a* and 9*b*) or start to display after the drive stage ends (as shown in FIGS. 11*a* and 11*b*), technical solutions of the present disclosure will not be influenced. Thus, Step S301 of the present embodiment and Step S201 of the above embodiment shown in FIG. 7 are interchangeable.

It should also be noted that, the above-described technical solution in which delimited areas are predetermined and light emitting time is adjusted in terms of delimited areas, merely represents an optional solution of the present disclosure, and is not intended to limit technical solutions of the present disclosure. It should be known to one skilled in the art that, in the present disclosure, adjustment is required only to be performed on the light emitting time of pixel units corresponding to the dynamic part in the display stage.

Figure 12:
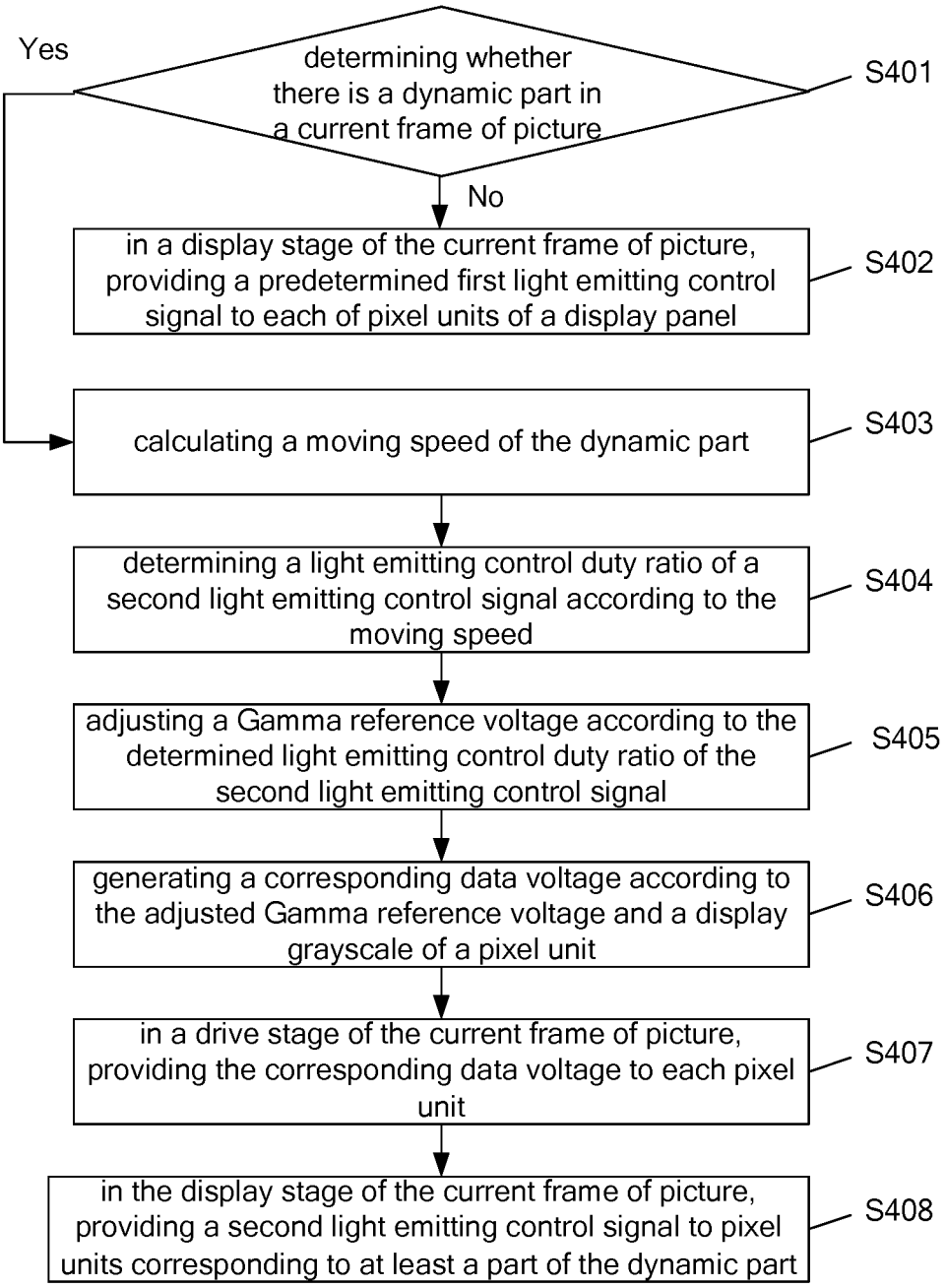
FIG. 12 is a flow chart of a display method according to an embodiment of the present disclosure.

FIG. 12 is a flow chart of a display method according to an embodiment of the present disclosure. As shown in FIG. 12, the display method may include Steps S401 through S408.

Step S401: determining whether there is a dynamic part in a current frame of picture, according to image data of a previous frame of picture and the current frame of picture.

If it is determined in Step S401 that there is no dynamic part in the current frame of picture, Step S402 is performed; otherwise, if it is determined in Step S401 that there is a dynamic part in the current frame of picture, Step S403 is performed.

Step S402: in a display stage of the current frame of picture, providing a predetermined first light emitting control signal to each of pixel units of a display panel.

Step S403: calculating a moving speed of the dynamic part.

In Step S403, according to position information of the dynamic part in the previous frame of picture and the current frame of picture, a displacement of the dynamic part in the time of one frame (approximately equals T) may be calculated, and the moving speed may be calculated from the displacement and the time.

Step S404: determining a light emitting control duty ratio of a second light emitting control signal according to the moving speed.

The light emitting control duty ratio of the second light emitting control signal is a ratio of a duration for which the second light emitting control signal is at an effective electric level state to a duration of the display stage.

In Step S404, the light emitting control duty ratio of the second light emitting control signal is determined according to the moving speed, wherein, the greater the moving speed, the smaller the light emitting control duty ratio of the second light emitting control signal (the shorter the duration for which the dynamic part is continuously displayed in the display stage).

By Steps S403 and S404, one can realize smart regulation of the light emitting control duty ratio of the second light emitting control signal according to the moving speed of the dynamic part, to improve display effect.

As an optional solution, a correspondence table may be stored in advance. The correspondence table records different moving speeds and light emitting control duty ratios corresponding thereto, respectively, predesigned by experiments. For example, after calculating the moving speed in Step S403, a corresponding light emitting control duty ratio may be determined by looking up in the table in Step S404.

Certainly, in the present disclosure, the light emitting control duty ratio as a function of moving speed may also be predesigned, and the moving speed calculated in Step S403 may be applied as an input, for obtaining the corresponding light emitting control duty ratio. With the function designed for Step S404, the light emitting control duty ratio decreases as the moving speed increases, and specific algorithm of the function is not limited herein.

Step S405: adjusting a Gamma reference voltage according to the determined light emitting control duty ratio of the second light emitting control signal.

Step S406: generating a corresponding data voltage according to the adjusted Gamma reference voltage and a display grayscale of a pixel unit.

Step S407: providing the corresponding data voltage to each pixel unit in a drive stage before the display stage.

When the second light emitting control signal is output to pixel units, because the pixel units which receive the second light emitting control signal have a shortened display duration during the display of a frame, in this case, a user may perceive that these pixel units exhibit low brightness. To address this technical problem, brightness compensation may be performed on the pixel units which receive the second light emitting control signal through the above Steps S405 through S407 in the present disclosure.

Figure 13:
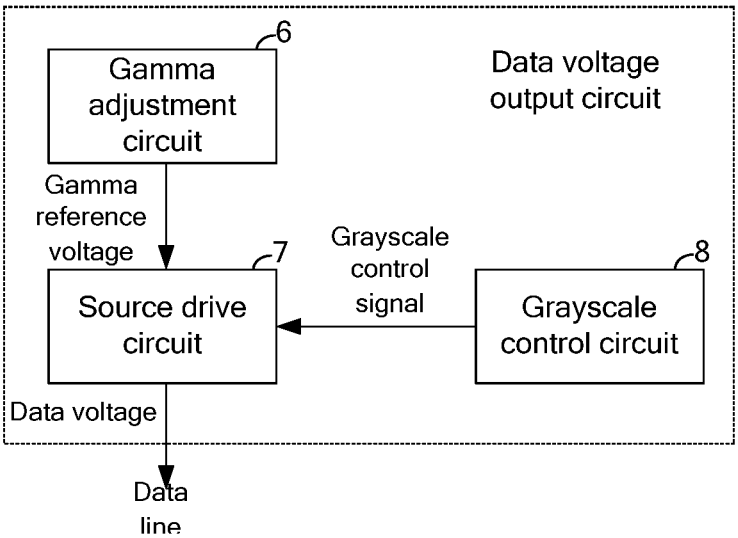
FIG. 13 is a schematic diagram of a structure of a data voltage output circuit.

FIG. 13 is a schematic diagram of a structure of a data voltage output circuit. As shown in FIG. 13, a display panel is provided with the data voltage output circuit for outputting a data voltage, and the data voltage output circuit may include a grayscale control circuit 8, a Gamma adjustment circuit 6 and a source drive circuit 7, wherein the grayscale control circuit 8 is coupled to the source drive circuit 7 and configured to output a grayscale control signal to the source drive circuit 7; the Gamma adjustment circuit 6 is coupled to the source drive circuit 7 and configured to adjust a Gamma reference voltage group and provide the adjusted Gamma reference voltage group to the source drive circuit 7, the Gamma reference voltage group may include a plurality of Gamma reference voltages; the source drive circuit 7 performs voltage division on Gamma reference voltages in the adjusted Gamma reference voltage group received from the Gamma adjustment circuit 6, according to the grayscale control signal received from the grayscale control circuit 8, to generate a data voltage of a corresponding grayscale. The source drive circuit 7 is coupled to a data line and is configured to output the data voltage to the data line.

The Gamma adjustment circuit 6 is generally provided with a plurality of different Gamma reference voltage groups, and the different Gamma reference voltage groups correspond to different brightness rendering abilities respectively. The "brightness rendering ability(abilities)" refers to, a ratio of the brightness rendered by the display panel, when the source drive circuit 7 outputs a data voltage having a grayscale of 255 based on the Gamma reference voltage group (for different Gamma reference voltage groups, with respect to a same grayscale, the source drive circuit 7 outputs different data voltages respectively), and outputs the data voltage to each of pixel units of the display panel, to the maximum brightness achievable by the display panel.

The process of adjusting the Gamma reference voltage will be described below in conjunction with a specific example. For example, a Gamma voltage output circuit may output seven different Gamma reference voltage groups: GAMMA1 through GAMMA7, and brightness rendering abilities corresponding to the respective Gamma reference voltage groups are shown in Table 1 below.

TABLE 1

Correspondence table of Gamma reference voltage groups and brightness rendering abilities

| Gamma reference voltage group | Brightness rendering ability |
|---|---|
| GAMMA1 | 100% |
| GAMMA2 | 85% |
| GAMMA3 | 70% |
| GAMMA4 | 55% |
| GAMMA5 | 40% |
| GAMMA6 | 25% |
| GAMMA7 | 10% |

The brightness rendering abilities corresponding to the Gamma reference voltage groups GAMMA1 through GAMMA7 are 100%, 85%, 70%, 55%, 40%, 25%, and 10%, respectively. Assuming that, when displaying a current frame, the Gamma voltage output circuit is initially set to output the Gamma reference voltage group GAMMA5, with respect to second light emitting control signals having different light emitting control duty ratios, the Gamma voltage output circuit may adjust the Gamma reference voltage group outputted thereby, as shown in Table 2 below.

TABLE 2

Adjustment solution table corresponding to GAMMA5 for different second light emitting control signals

| Initially set Gamma reference voltage group | Light emitting control duty ratio of the second light emitting control signal | Adjusted Gamma reference voltage group |
|---|---|---|
| GAMMA5 | [90%, 100%) | GAMMA5 remain unchanged |
| GAMMA5 | [70%, 90%) | GAMMA4 |
| GAMMA5 | [50%, 70%) | GAMMA3 |
| GAMMA5 | [20%, 50%) | GAMMA2 |
| GAMMA5 | (0, 20%) | GAMMA1 |

When the Gamma adjustment circuit 6 obtains the Gamma reference voltage group from the Gamma voltage output circuit, and adjusts the Gamma reference voltage according to the light emitting control duty ratio of the second light emitting control signal, the brightness rendering ability corresponding to the adjusted Gamma reference voltage group should be no less than the brightness rendering ability corresponding to the Gamma reference voltage group before adjustment, and there should render an overall tendency that the brightness rendering ability corresponding to the adjusted Gamma reference voltage group rises with the decrease of the light emitting control duty ratio. After the adjustment of the Gamma reference voltage is completed, pixel units subject to control of the second light emitting control signal, upon receiving the data voltage, have an increased light emitting brightness corresponding thereto, so as to compensate for the problem of low user perceived brightness caused by short duration of light emission.

In practical applications, for each of the above Gamma reference voltage groups GAMMA2 through GAMMA7, a corresponding adjustment solution table may be provided, respectively (there is no need to provide an adjustment solution table for the Gamma reference voltage group GAMMA1).

It is to be noted that, the correspondence table of Gamma reference voltage groups and brightness rendering abilities as shown in Table 1 and the adjustment solution table corresponding to GAMMA5 as shown in Table 2, merely serve as exemplarily examples, and are not intended to limit technical solutions of the present disclosure.

Step S408: in the display stage of the current frame of picture, providing a second light emitting control signal to pixel units corresponding to at least a part of the dynamic part.

As for specific description of Step S408, one can refer to the foregoing description of Step S103 of the embodiment shown in FIG. 3, Step S204 of the embodiment shown in FIG. 7, and Step S304 of the embodiment shown in FIG. 10, which is not repeated herein.

An embodiment of the present disclosure provides a display method, which can adjust the light emitting control duty ratio of the second light emitting control signal according to the moving speed of the moving part in the display panel, to realize smart weakening of smearing blur feeling according to the moving speed; at the same time, adjusting the Gamma reference voltage according to the light emitting control duty ratio, can compensate for the problem of low perceived brightness of pixel units caused in the process of weakening the smearing blur feeling.

Figure 14:
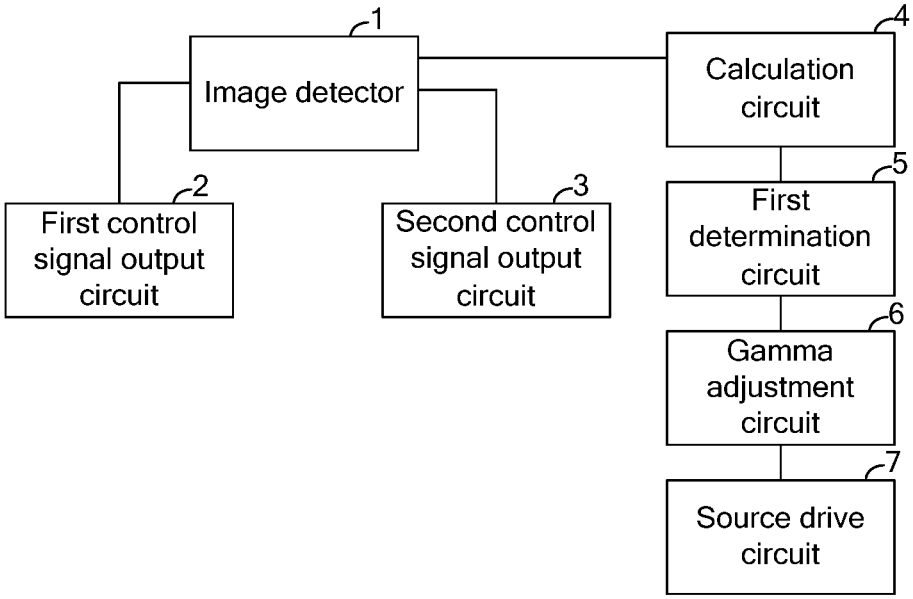
FIG. 14 is a schematic diagram of a structure of a display control device according to an embodiment of the present disclosure.

FIG. 14 is a schematic diagram of a structure of a display control device according to an embodiment of the present disclosure. As shown in FIG. 14, the display control device can realize the display control method provided by the above embodiments, and the display control device may include an image detector 1, a first control signal output circuit 2 and a second control signal output circuit 3.

The image detector 1 is coupled to the first control signal output circuit 2 and the second control signal output circuit 3 respectively, and is configured to determine whether there is a dynamic part in a current frame of picture, according to image data of a previous frame of picture and the current frame of picture.

The first control signal output circuit 2 is configured to provide, in a case where the image detector 1 determines that there is no dynamic part in the current frame of picture, a first light emitting control signal to each of pixel units of a display panel in a display stage of the current frame of picture. The first light emitting control signal is always at an effective electric level state.

The second control signal output circuit 3 is configured to, in a case where the image detector 1 determines that there is a dynamic part in the current frame of picture, provide a second light emitting control signal to pixel units corresponding to at least a part of the dynamic part in the display stage of the current frame of picture. The second light emitting control signal includes: a part at an effective electric level state and a part at a non-effective electric level state, wherein the part at the effective electric level state corresponds to time during which the display stage is at an effective electric level state, the part at the non-effective electric level state corresponds to time during which the display stage is at a non-effective electric level state. For example, time during which the display stage is at the non-effective electric level state may be a period of time after the display stage starts and/or a period of time before the display stage ends.

The image detector 1, the first control signal output circuit 2 and the second control signal output circuit 3 may be a chip having an image detecting function and an information output function.

It is to be noted that, the image detector 1 may perform Step S101 of the embodiment as shown in FIG. 3, Step S202 of the embodiment as shown in FIG. 7, Step S302 of the embodiment as shown in FIG. 10, and Step S401 of the embodiment as shown in FIG. 12. The first control signal output circuit 2 may perform Step S102 of the embodiment as shown in FIG. 3, Steps S203 and S205 of the embodiment as shown in FIG. 7, Step S303 of the embodiment as shown in FIG. 10, and Step S402 of the embodiment as shown in FIG. 12. The second control signal output circuit 3 may perform Step S103 of the embodiment as shown in FIG. 3, Step S204 of the embodiment as shown in FIG. 7, Step S304 of the embodiment as shown in FIG. 10, and Step S408 of the embodiment as shown in FIG. 12. Specific description may be found in the foregoing contents of the above-described embodiments.

Optionally, the display control device may also include a calculation circuit 4 and a first determination circuit 5.

The calculation circuit 4 is coupled to the image detector 1 and the first determination circuit 5, and configured to calculate a moving speed of the dynamic part according to image data of the previous frame of picture and the current frame of picture, and send the calculated moving speed of the dynamic part to the first determination circuit 5.

The first determination circuit 5 is coupled to the calculation circuit 4, and configured to determine a light emitting control duty ratio of the second light emitting control signal according to the moving speed of the dynamic part calculated by the calculation circuit 4; the light emitting control duty ratio of the second light emitting control signal is a ratio of a duration for which the second light emitting control signal is at an effective electric level state to a duration of the display stage.

Optionally, the display control device may also include a Gamma adjustment circuit 6 and a source drive circuit 7.

The Gamma adjustment circuit 6 is coupled to the first determination circuit 5, and configured to, after the first determination circuit 5 determines the light emitting control duty ratio of the second light emitting control signal, adjust a Gamma reference voltage according to the light emitting control duty ratio of the second light emitting control signal determined by the first determination circuit 5.

The source drive circuit 7 is coupled to the Gamma adjustment circuit 6, and configured to generate a corresponding data voltage, according to the Gamma reference voltage adjusted by the Gamma adjustment circuit 6 and a display grayscale of a pixel unit, and send the generated data voltage to a data line, to provide the corresponding data voltage to the pixel unit.

For example, the calculation circuit 4 and the first determination circuit 5 may be a chip having a data processing function; the Gamma adjustment circuit 6 and the source drive circuit 7 may be a chip having a voltage output function.

It is to be noted that, the calculation circuit 4 may perform Step S403 of the embodiment as shown in FIG. 12, the first determination circuit 5 may perform Step S404 of the embodiment as shown in FIG. 12, the Gamma adjustment circuit 6 may perform Step S405 of the embodiment as shown in FIG. 12, and the source drive circuit 7 may perform Steps S406 and S407 of the embodiment as shown in FIG. 12. Specific description may be found in the foregoing contents of the above-described embodiments.

An embodiment of the present disclosure provides a display control device, which detects, by the image detector, whether there is a dynamic part in a displayed picture, and in a case where it is detected that there is a dynamic part, provides, by the second control signal output circuit, a second light emitting control signal to pixel units corresponding to at least a part of the dynamic part, such that these pixel units does not emit light during a period of time when the display stage of the current frame of picture is at a non-effective electric level state, to shorten a duration during which the dynamic part is continuously displayed in the current frame of picture, thereby reducing the maximum deviation of a perceptual position of a moving part perceived by the user's brain from an actual position of the moving part actually observed by the user's eyes, that is, the longest smear that can be felt by the user is shortened, and the feeling of smearing blur is weakened.

An embodiment of the present disclosure provides a display apparatus, which may include the display control device provided in the above embodiment shown in FIG. 14.

It should be understood that, the above embodiments are only exemplary embodiments for the purpose of explaining the principle of the present disclosure, and the present disclosure is not limited thereto. For one of ordinary skill in the art, various improvements and modifications may be made without departing from the spirit and essence of the present disclosure. These improvements and modifications also fall within the protection scope of the present disclosure.

What is claimed is:

1. A display method, comprising:

determining whether there is a dynamic part in a current frame of picture, according to image data of a previous frame of picture and the current frame of picture;

in a case where there is no dynamic part in the current frame of picture, in a display stage of the current frame of picture, providing a first light emitting control signal to each of pixel units of a display panel, wherein the first light emitting control signal corresponds to the display stage being always at an effective electric level state;

in a case where there is a dynamic part in the current frame of picture, in the display stage of the current frame of picture, providing a second light emitting control signal to pixel units corresponding to at least a part of the dynamic part, wherein the second light emitting control signal comprises a part at an effective electric level state and a part at a non-effective electric level state, wherein the display panel is divided into a number of delimited areas in advance, and the pixel units located in a same one of the delimited areas correspond to a same light emitting control signal input terminal;

the step of, in the display stage of the current frame of picture, providing a second light emitting control signal to pixel units corresponding to at least a part of the dynamic part, comprises:

in the display stage of the current frame of picture, providing the second light emitting control signal to each of pixel units in those of the delimited areas where the dynamic part is present, by light emitting control signal input terminals corresponding to the delimited areas where the dynamic part is present, and wherein the display method further comprises:

in a drive stage before the display stage, providing a third light emitting control signal to each of the pixel units in each of the delimited areas, by each of the light emitting control signal input terminals, wherein the third light emitting control signal comprises a part at an effective electric level state and a part at a non-effective electric level state, and switching of the third light emitting control signal, received by each of the delimited areas, from the non-effective electric level state to the effective electric level state occurs at sequentially delayed moments respectively.

2. The display method according to claim 1, wherein the part at the non-effective electric level state corresponds to at least one of a period of time after the display stage starts and a period of time before the display stage ends.

3. The display method according to claim 1, before the step of, in the display stage of the current frame of picture, providing a second light emitting control signal to pixel units corresponding to at least a part of the dynamic part, further comprising:

calculating a moving speed of the dynamic part; and determining a light emitting control duty ratio of the second light emitting control signal according to the moving speed, wherein the light emitting control duty ratio of the second light emitting control signal is a ratio of a duration for which the second light emitting control signal is at an effective electric level state to a duration of the display stage.

4. The display method according to claim 3, after the step of determining a light emitting control duty ratio of the second light emitting control signal according to the moving speed, further comprising:

adjusting a Gamma reference voltage according to the determined light emitting control duty ratio of the second light emitting control signal;

generating a corresponding data voltage according to the adjusted Gamma reference voltage and a display gray-scale of the pixel units; and in a drive stage before the display stage, providing the corresponding data voltage to the pixel units.

5. The display method according to claim 1, further comprising:

after determining that there is the dynamic part in the current frame of picture, in the display stage of the current frame of picture, providing the first light emitting control signal to each of pixel units in those of the delimited areas where the dynamic part is not present, by light emitting control signal input terminals corresponding to the delimited areas where the dynamic part is not present.

6. The display method according to claim 1, further comprising: in a drive stage before the display stage, providing a fourth light emitting control signal to each of the pixel units in each of the delimited areas, by each of the light emitting control signal input terminals, wherein the fourth light emitting control signal is always at a non-effective electric level state.

7. The display method according to claim 1, wherein a number of the delimited areas ranges from 2 to 6.

8. The display method according to claim 7, wherein a number of the delimited areas is 4.

9. A display control device for implementing the display method of claim 1, comprising:

an image detector, configured to determine whether there is a dynamic part in a current frame of picture, according to image data of a previous frame of picture and the current frame of picture;

a first control signal output circuit, coupled to the image detector, and configured to provide, in a case where the image detector determines that there is no dynamic part in the current frame of picture, in a display stage of the current frame of picture, a first light emitting control signal to each of pixel units of a display panel, wherein the first light emitting control signal corresponds to the display stage being always at an effective electric level state;

a second control signal output circuit, coupled to the image detector, and configured to, in a case where the image detector determines that there is a dynamic part in the current frame of picture, in the display stage of the current frame of picture, provide a second light emitting control signal to pixel units corresponding to at least a part of the dynamic part, wherein the second light emitting control signal comprises a part at an effective electric level state and a part at a non-effective electric level state, wherein the display panel is divided into a number of delimited areas in advance, and the pixel units located in a same one of the delimited areas correspond to a same light emitting control signal input terminal;

in the display stage of the current frame of picture, the second control signal output circuit provides the second light emitting control signal to each of pixel units in those of the delimited areas where the dynamic part is present, by light emitting control signal input terminals corresponding to the delimited areas where the dynamic part is present, and in a drive stage before the display stage, the second control signal output circuit provides a third light emitting control signal to each of the pixel units in each of the delimited areas, by each of the light emitting control signal input terminals, wherein the third light emitting control signal comprises a part at an effective electric level state and a part at a non-effective electric level state, and switching of the third light emitting control signal, received by each of the delimited areas, from the non-effective electric level state to the effective electric level state occurs at sequentially delayed moments respectively.

10. The display control device according to claim 9, further comprising:

a calculation circuit, coupled to the image detector, and configured to calculate a moving speed of the dynamic part according to image data of the previous frame of picture and the current frame of picture; and a first determination circuit, coupled to the calculation circuit, and configured to determine a light emitting control duty ratio of the second light emitting control signal according to the moving speed, wherein the light emitting control duty ratio of the second light emitting control signal is a ratio of a duration for which the second light emitting control signal is at an effective electric level state to a duration of the display stage.

11. The display control device according to claim 10, further comprising:

a Gamma adjustment circuit, coupled to the first determination circuit, and configured to, after the first determination circuit determines the light emitting control duty ratio of the second light emitting control signal, adjust a Gamma reference voltage according to the light emitting control duty ratio of the second light emitting control signal determined by the first determination circuit;

a source drive circuit, coupled to the Gamma adjustment circuit, and configured to generate a corresponding data voltage, according to the adjusted Gamma reference voltage and a display grayscale of the pixel units, and provide the corresponding data voltage to the pixel units.

12. A display apparatus, comprising: the display control device according to claim 9.

13. A display method, comprising:

determining whether there is a dynamic part in a current frame of picture, according to image data of a previous frame of picture and the current frame of picture;

in a case where there is no dynamic part in the current frame of picture, in a display stage of the current frame of picture, providing a first light emitting control signal to each of pixel units of a display panel, wherein the first light emitting control signal corresponds to the display stage being always at an effective electric level state;

in a case where there is a dynamic part in the current frame of picture, in the display stage of the current frame of picture, providing a second light emitting control signal to pixel units corresponding to at least a part of the dynamic part, wherein the second light emitting control signal comprises a part at an effective electric level state and a part at a non-effective electric level state, wherein the display panel is divided into a number of delimited areas in advance, and the pixel units located in a same one of the delimited areas correspond to a same light emitting control signal input terminal;

the step of, in the display stage of the current frame of picture, providing a second light emitting control signal to pixel units corresponding to at least a part of the dynamic part, comprises:

in the display stage of the current frame of picture, providing the second light emitting control signal to each of pixel units in each of the delimited areas, by each of corresponding light emitting control signal input terminals, and wherein the display method further comprises:

in a drive stage before the display stage, providing a third light emitting control signal to each of the pixel units in each of the delimited areas, by each of the corresponding light emitting control signal input terminals, wherein the third light emitting control signal comprises a part at an effective electric level state and a part at a non-effective electric level state, and switching of the third light emitting control signal, received by each of the delimited areas, from the non-effective electric level state to the effective electric level state occurs at sequentially delayed moments respectively.

14. The display method according to claim 13, wherein the second light emitting control signals received by respective ones of the delimited areas are at an effective electric level state at sequentially staggered times respectively.

15. The display method according to claim 14, wherein each of the second light emitting control signals received by respective ones of the delimited areas is at an effective electric level state for a duration $t=T/m$;

where T is a duration of the display stage, and m is a number of the delimited areas.

16. The display method according to claim 13, further comprising: in a drive stage before the display stage, providing a fourth light emitting control signal to each of the pixel units in each of the delimited areas, by each of the light emitting control signal input terminals, wherein the fourth light emitting control signal is always at a non-effective electric level state.

17. The display method according to claim 13, wherein the part at the non-effective electric level state corresponds to at least one of a period of time after the display stage starts and a period of time before the display stage ends.

18. The display method according to claim 13, before the step of, in the display stage of the current frame of picture, providing a second light emitting control signal to pixel units corresponding to at least a part of the dynamic part, further comprising:

calculating a moving speed of the dynamic part; and determining a light emitting control duty ratio of the second light emitting control signal according to the moving speed, wherein the light emitting control duty ratio of the second light emitting control signal is a ratio of a duration for which the second light emitting control signal is at an effective electric level state to a duration of the display stage.

19. The display method according to claim 18, after the step of determining a light emitting control duty ratio of the second light emitting control signal according to the moving speed, further comprising:

adjusting a Gamma reference voltage according to the determined light emitting control duty ratio of the second light emitting control signal;

generating a corresponding data voltage according to the adjusted Gamma reference voltage and a display gray-scale of the pixel units; and in a drive stage before the display stage, providing the corresponding data voltage to the pixel units.

20. A display control device for implementing the display method of claim 13, comprising:

an image detector, configured to determine whether there is a dynamic part in a current frame of picture, according to image data of a previous frame of picture and the current frame of picture;

a first control signal output circuit, coupled to the image detector, and configured to provide, in a case where the image detector determines that there is no dynamic part in the current frame of picture, in a display stage of the current frame of picture, a first light emitting control signal to each of pixel units of a display panel, wherein the first light emitting control signal corresponds to the display stage being always at an effective electric level state;

a second control signal output circuit, coupled to the image detector, and configured to, in a case where the image detector determines that there is a dynamic part in the current frame of picture, in the display stage of the current frame of picture, provide a second light emitting control signal to pixel units corresponding to at least a part of the dynamic part, wherein the second light emitting control signal comprises a part at an effective electric level state and a part at a non-effective electric level state, wherein the display panel is divided into a number of delimited areas in advance, and the pixel units located in a same one of the delimited areas correspond to a same light emitting control signal input terminal;

in the display stage of the current frame of picture, second control signal output circuit provides the second light emitting control signal to each of pixel units in each of the delimited areas, by each of corresponding light emitting control signal input terminals, and in a drive stage before the display stage, second control signal output circuit provides a third light emitting control signal to each of the pixel units in each of the delimited areas, by each of the corresponding light emitting control signal input terminals, wherein the third light emitting control signal comprises a part at an effective electric level state and a part at a non-effective electric level state, and switching of the third light emitting control signal, received by each of the delimited areas, from the non-effective electric level state to the effective electric level state occurs at sequentially delayed moments respectively.

* * * * *